US007856963B2

(12) United States Patent
Hopley et al.

(10) Patent No.: US 7,856,963 B2
(45) Date of Patent: Dec. 28, 2010

(54) METHOD OF OPERATING A FUEL INJECTOR

(75) Inventors: Daniel J Hopley, Chislehurst (GB); Stephen A Noyce, Poole (GB); Colin Almond, Rochester (GB)

(73) Assignee: Delphi Technologies Holding S.arl, Troy, MI (US)

( * ) Notice: Subject to any disclaimer, the term of this patent is extended or adjusted under 35 U.S.C. 154(b) by 836 days.

(21) Appl. No.: 11/805,284

(22) Filed: May 22, 2007

(65) Prior Publication Data

US 2007/0273246 A1 Nov. 29, 2007

(30) Foreign Application Priority Data

May 23, 2006 (GB) ..... 0610229.7
Aug. 30, 2006 (GB) ..... 0617094.8

(51) Int. Cl.
*F02M 51/00* (2006.01)

(52) U.S. Cl. ..... 123/472; 701/103

(58) Field of Classification Search ..... 123/295, 123/299, 472, 498; 239/533.3; 701/102, 701/103

See application file for complete search history.

(56) References Cited

U.S. PATENT DOCUMENTS 4,784,102 A 11/1988 Toshihiko
5,957,109 A 9/1999 Schonfelder
6,155,500 A 12/2000 Takase
2003/0150420 A1 * 8/2003 Ishikawa et al. ..... 123/300
2004/0169436 A1 9/2004 Yasuhiro
2005/0234630 A1 * 10/2005 Nakazawa et al. ..... 701/102
2006/0096575 A1 * 5/2006 Araki et al. ..... 123/406.47

FOREIGN PATENT DOCUMENTS

| | | |
|---|---|---|
| DE | 10146068 | 4/2003 |
| EP | 0 995 899 | 4/2000 |
| EP | 1 398 487 | 3/2004 |
| EP | 1 411 239 | 4/2004 |
| EP | 1 772 952 | 4/2007 |
| JP | 10227249 | 8/1998 |
| JP | 2000-23474 | 1/2000 |
| WO | WO 2004/082117 | 9/2004 |

OTHER PUBLICATIONS

Japan Office Action dated Nov. 26, 2009.
European Search Report dated Jul. 15, 2008.

* cited by examiner

*Primary Examiner*—Stephen K Cronin
*Assistant Examiner*—J. Page Hufty
(74) *Attorney, Agent, or Firm*—Thomas N. Twomey

(57) ABSTRACT

A method of operating a fuel injector having a piezoelectric actuator operable by applying a drive pulse thereto, wherein the drive pulse has a frequency domain signature. The method includes i) determining at least one resonant frequency of an injector installation in which the injector is received, in use, and ii) modifying the drive pulse such that a maximum of the frequency domain signature thereof is remote from the determined resonant frequency of the injector installation.

19 Claims, 12 Drawing Sheets

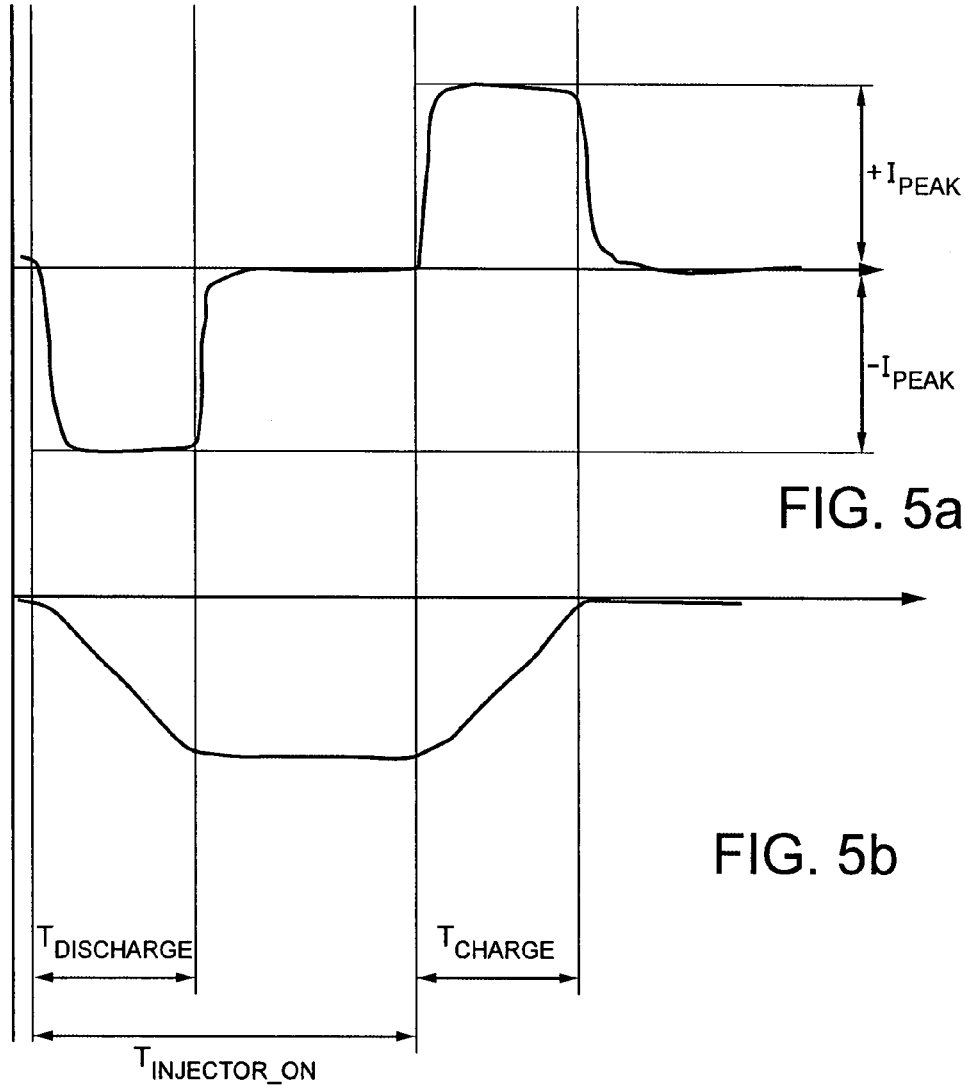
FIG. 5a
FIG. 5b
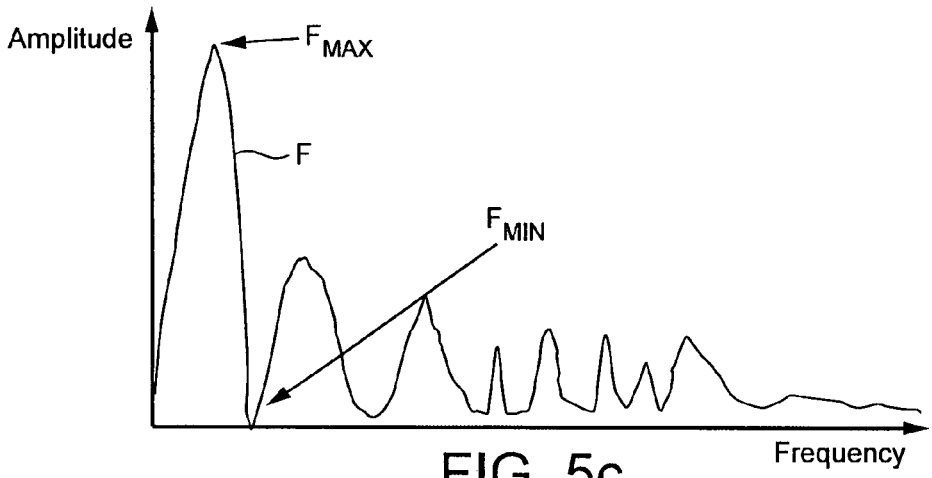
FIG. 5c

METHOD OF OPERATING A FUEL INJECTOR

TECHNICAL FIELD

The invention relates to a method of operating a fuel injector. More specifically, the invention relates to a method of operating a piezoelectrically actuated fuel injector in order to reduce the level of noise that is generated by the injector.

BACKGROUND TO THE INVENTION

In a direct injection internal combustion engine, a fuel injector is provided to deliver a charge of atomised fuel into a combustion chamber prior to ignition. Typically, the fuel injector is mounted in a cylinder head of an engine with respect to the combustion chamber such that a tip of the injector protrudes slightly into the chamber to permit the fuel charge to be delivered thereto.

One type of fuel injector that is particularly suited for use in a direct injection engine is a so-called piezoelectric injector. Such an injector allows precise control of the timing of an injection event and of the total volume of fuel that is delivered to the combustion chamber during the injection event. This permits accurate control over the combustion process which is beneficial for fuel efficiency and exhaust emissions.

A known piezoelectric injector 2 and its associated control system 3 is shown schematically in FIG. 1. The piezoelectric injector 2 includes a piezoelectric actuator 4 that is operable to control the position of an injector valve needle 6 relative to a valve needle seat 8. As known in the art, the piezoelectric actuator 4 includes a stack 7 of piezoelectric elements that expands and contacts in dependence on the voltage across the stack 7. The axial position, or 'lift', of the valve needle 6 is controlled by applying a variable voltage 'V' to the piezoelectric actuator 4. Although not shown in FIG. 1, it should be appreciated that, in practice, the variable voltage would be applied to the actuator by connecting a power supply plug to the terminals of the injector.

Through application of an appropriate voltage across the actuator, the valve needle 6 is caused either to disengage the valve seat 8, in which case fuel is delivered into an associated combustion chamber (not shown) through a set of nozzle outlets 10, or is caused to engage the valve seat 8, in which case fuel delivery through the outlets 10 is prevented.

For further background to the invention, an injector of this type is described in applicant's European Patent No. EP0955901B. Such fuel injectors can be used in compression-ignition (diesel) engines or spark ignition (petrol) engines.

Although piezoelectric injectors are adept at delivering precise quantities of fuel with accurate timing, they also have associated disadvantages. For example, during use, a piezoelectric injector emits vibrations due to the frequency of the drive voltage that is applied to the piezoelectric actuator. The vibrations travel down the injector, or through an injector positioning/clamping arrangement, and are transmitted to the engine. The engine accentuates certain frequencies such that at least a portion of the vibrations can be detected by the human ear.

At moderate and high engine speeds, the emitted noise of the injectors is drowned out by the combustion noise of the engine. However, at low engine speeds, particularly at an engine idle operating condition and with the bonnet/hood raised, the audible injector noise is apparent. The detectable noise contributes to the overall noise/vibration/harshness (NVH) characteristics of the vehicle.

The optimisation of NVH characteristics is a significant factor in successful vehicle design since it influences the buying decision of the consumer. It is therefore desirable to reduce the amount of noise emitted by the injector in an effort to reduce the overall level of noise perceived by the user of the vehicle.

SUMMARY OF THE INVENTION

Against this background, the invention provides a method of operating a fuel injector, the injector having a piezoelectric actuator operable by applying a drive pulse thereto, wherein the drive pulse has a frequency domain signature, the method including determining at least one resonant frequency of an injector installation in which the injector is received, in use, and modifying the drive pulse such that a maximum/maxima of the frequency domain signature is remote from or does not coincide with the determined resonant frequency of the injector installation.

By configuring the drive pulse such that its dominant frequencies are remote from the or each resonant frequency of the injector installation, a substantial reduction in noise is achieved.

The drive pulse may be defined by a plurality of drive pulse characteristics including a discharge time period, an injector on time period and a peak discharge/charge current amplitude such that the step of modifying the injector drive pulse includes modifying one or more of selected ones of said characteristics.

In one embodiment, in order to reduce the volume of fuel delivered by the injector during a first series of successive injection events, the method includes reducing the injector on time period to a predetermined injector on time threshold value and, for subsequent reductions in fuel delivery volume, holding the injector on time period substantially constant and thereafter reducing the discharge time period.

For a subsequent series of successive injection events, the injector on time period may be held substantially constant, the discharge time period may be held substantially constant, and the peak discharge/charge current amplitude may be reduced to a predetermined peak current threshold value in order to further reduce the volume of fuel that is delivered by the injector over the subsequent series of successive injection events.

In an alternative embodiment, in order to reduce the volume of fuel delivered by the injector during a first series of successive injection events, the method includes reducing the injector on time period to a predetermined injector on time threshold value and, for subsequent reductions in fuel delivery volume, holding the injector on time period substantially constant and thereafter reducing the peak discharge/charge current amplitude to a predetermined peak current threshold value. In this embodiment, for a subsequent series of successive injection events, the injector on time period may be held substantially constant, the peak discharge/charge current amplitude may be held substantially constant, and the discharge time period may be reduced in order to further reduce the volume of fuel that is delivered by the injector.

In another embodiment, where an injection comprises a plurality of injector drive pulses, for example in the form of first and second pilot drive pulses and a single main drive pulse, the temporal separation between successive drive pulses may be selected so as to modify the frequency domain signature of the drive pulse sequence such that a maximum of the frequency domain signature is remote from the determined resonant frequency of the injector installation. This provides further flexibility in modifying the characteristics of an injection event in order to achieve a reduction in emitted noise.

In another aspect, the invention provides a computer program product comprising at least one computer program software portion which, when executed in an executing environment, is operable to implement the method as set forth above.

In yet another aspect, the invention provides a data storage medium having the or each computer program product stored thereon.

In another aspect, the invention provides a microcomputer provided with the data storage medium thereon.

For the purpose of this description and claims, reference to a "series" of injection events should be taken to include one or more injection events.

BRIEF DESCRIPTION OF DRAWINGS

Reference has already been made to FIG. 1 which is a schematic representation of a known piezoelectric injector 2 and its associated control system, including an injector drive circuit. In order that it may be more readily understood, the invention will now be described with reference also to the following figures, in which:

FIG. 5*a* is a drive current profile corresponding to the drive current profile in FIG. 4*e* but filtered at approximately 20 kHz;

FIG. 5*b* is a drive voltage profile corresponding to the drive current profile in FIG. 5*a;*

FIG. 5*c* is a frequency spectrum of the drive current profile of FIG. 5*a*

DETAILED DESCRIPTION

Figure 1:
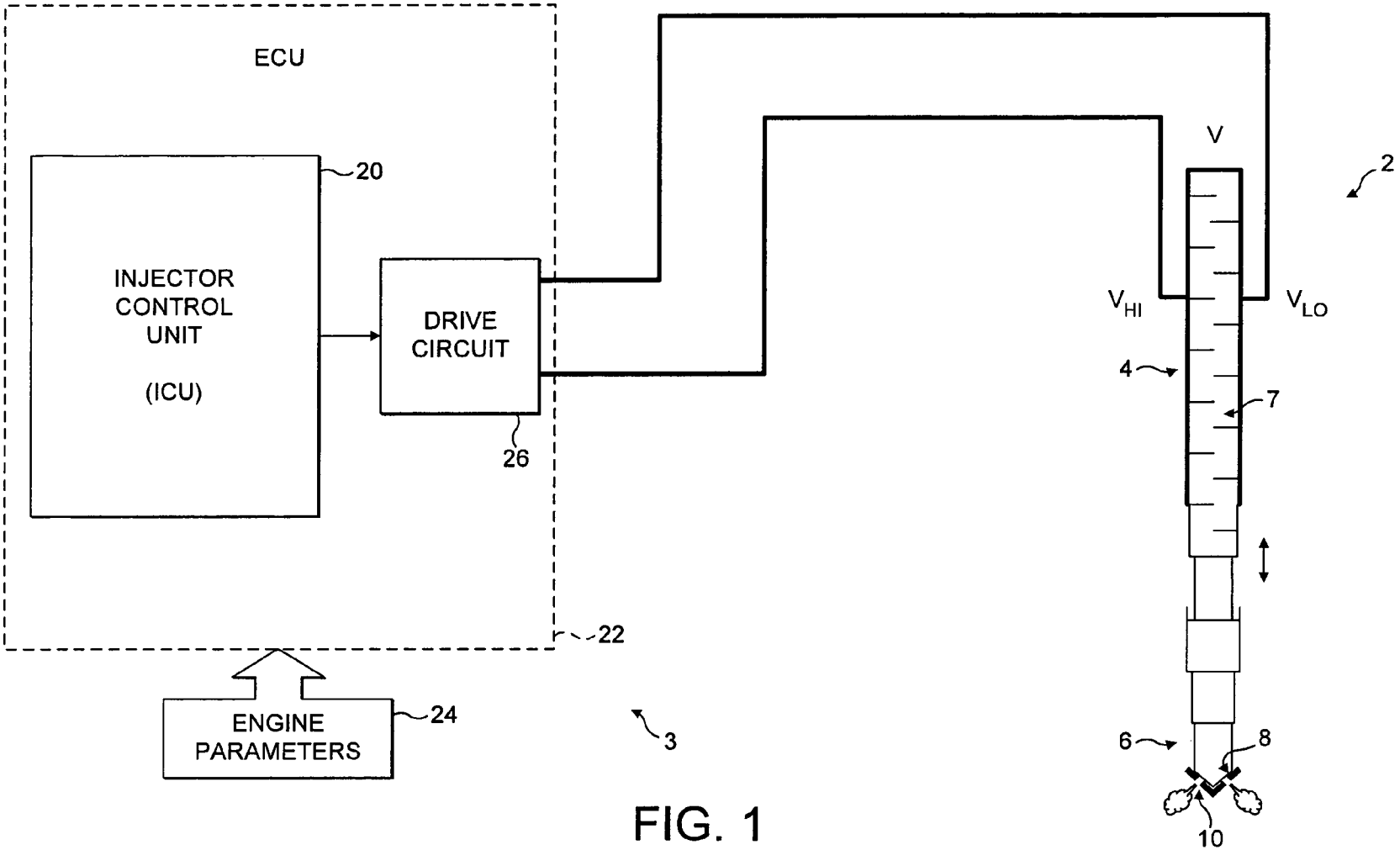

Referring again to FIG. 1, the piezoelectric injector 2 is controlled by an injector control unit 20 (hereinafter 'ICU') that forms an integral part of an engine control unit 22 (ECU). The ECU 22 monitors a plurality of engine parameters 24 and calculates an engine power requirement signal (not shown) which is input to the ICU 20. In turn, the ICU 20 calculates a required injection event sequence to provide the required power for the engine and operates an injector drive circuit 26 accordingly. The injector drive circuit 26 is also shown as integral to the ECU 22, although it should be appreciated that this is not essential to the invention.

In order to initiate an injection, the injector drive circuit 26 causes the differential voltage between the high and low voltage terminals of the injector, $V_1$ and $V_2$, to transition from a high voltage (typically 200 V) at which no fuel delivery occurs, to a relatively low voltage (typically −30 V), which reduces the voltage of the piezoelectric actuator 4 and therefore initiates fuel delivery. An injector responsive to this drive waveform is referred to as a 'de-energise to inject' injector and is operable to deliver one or more injections of fuel within a single injection event. For example, the injection event may include one or more so-called 'pre-' or 'pilot' injections, a main injection, and one or more 'post' injections. In general, several such injections within a single injection event are preferred to increase combustion efficiency of the engine.

Figure 2:
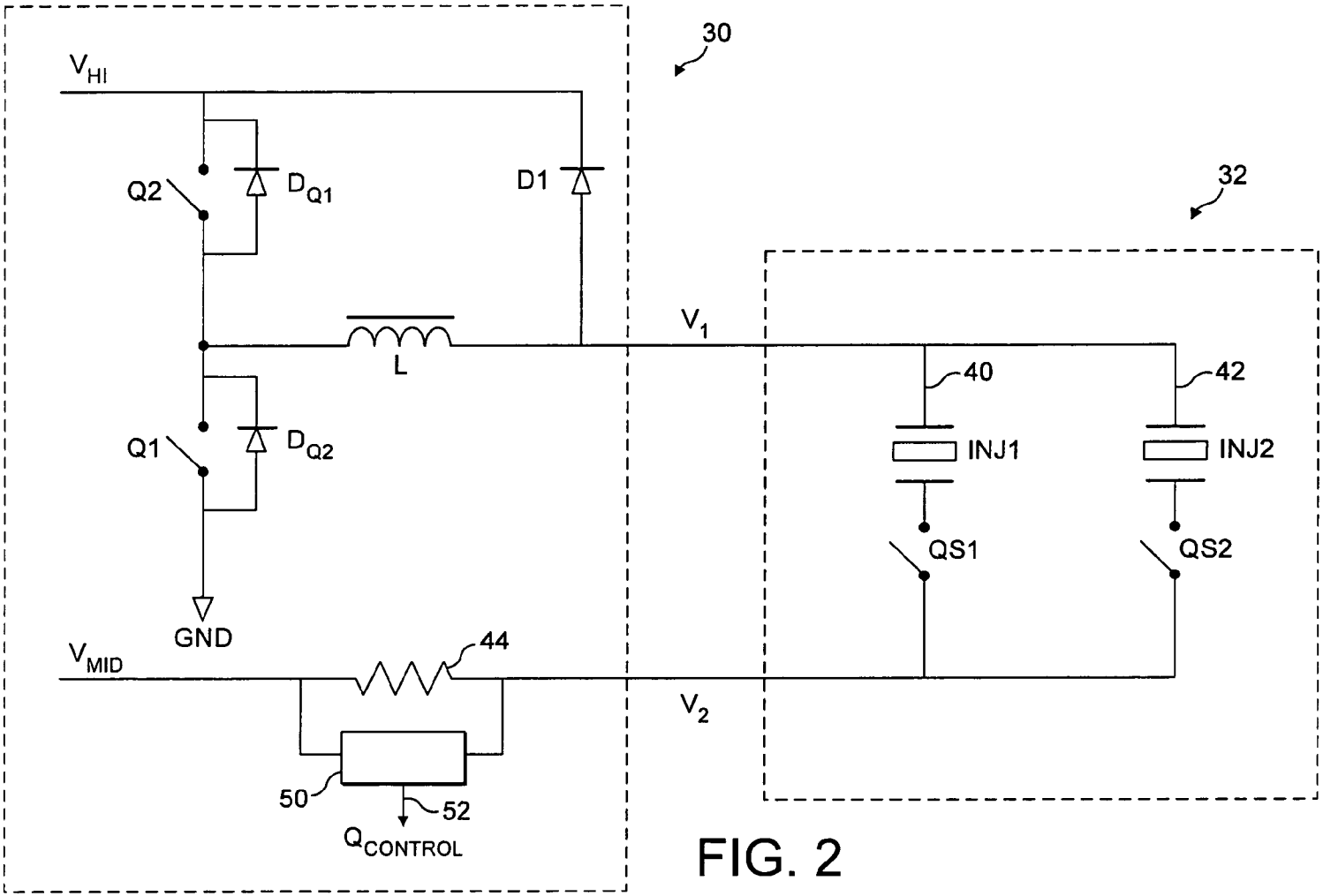
FIG. 2 is a circuit diagram of the injector drive circuit in FIG. 1.
Figure 3:
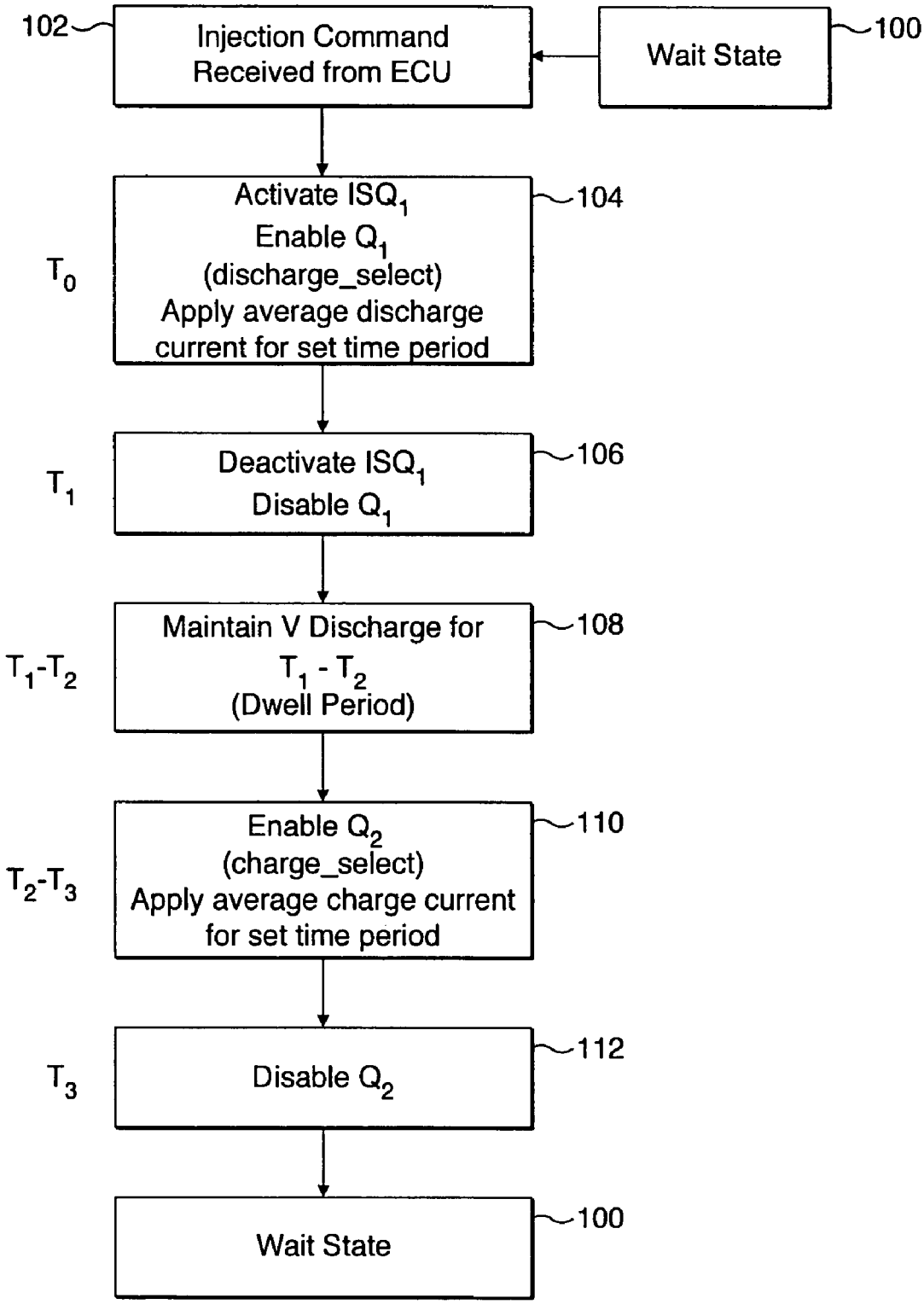
FIG. 3 is a flow chart of a known method of operating the circuit of FIG. 2.

Referring also to FIG. 2, the injector drive circuit 26 includes an injector charge/discharge switching circuit 30 (hereinafter 'switching circuit') that is connected to an injector bank circuit 32 so as to control the voltage applied to a high side voltage input V1 and a low side voltage input V2 of the bank circuit 32.

The injector bank circuit 32 includes first and second branches 40, 42 both of which are connected in parallel between the high and low side voltage inputs V1 and V2. Each branch 40, 42 includes a respective injector INJ1, INJ2 and injector select switch QS1, QS2 by which means either one of the injectors can be selected for operation, as will be described later. It should be mentioned at this point that the piezoelectric actuator 4 of each injector 2 is considered electrically equivalent to a capacitor, the voltage difference between V1 and V2 determining the amount of electrical charge stored by the actuator and, thus, the position of the injector valve needle 8.

The switching circuit 30 includes three input voltage rails: a high voltage rail $V_{HI}$ (typically 230 V), a mid voltage rail $V_{MID}$ (typically 30 V) and a ground connection GND. The switching circuit 30 is operable to connect the high side voltage input V1 of the injector bank circuit to either the high voltage rail $V_{HI}$ or the ground connection GND by means of first and second switches Q1, Q2 to which the injector bank 32 is connected, through an inductor L.

The switching circuit 30 is also provided with a diode D1 that connects the high side voltage input V1 of the bank circuit 32 to the high voltage rail $V_{HI}$. The diode D1 is oriented to permit current to flow from the high side input V1 of the bank circuit 32 to the high voltage rail $V_{HI}$ but to prevent current flow from the high voltage rail $V_{HI}$ to the high side voltage input V1 of the bank circuit 32.

The first switch Q1, when activated, connects the high side input V1 of the selected injector to the ground connection GND via the inductor L. Therefore, charge from the injector is permitted to flow from the selected injector, through the inductor L and the first switch Q1 to the ground connection GND, thereby serving to discharge the selected injector during an injector discharge phase. Hereinafter, the first switch will therefore be referred to as the 'discharge select switch' Q1. A diode $D_{Q1}$ is connected across the second switch Q2 and is oriented to permit current to flow from the inductor L to the high voltage rail $V_{HI}$ when the discharge select switch Q1 is deactivated, thus guarding against voltage peaks across the inductor L.

In contrast, the second switch Q2, when activated, connects the high side input V1 of the selected injector to the high voltage rail $V_{HI}$ via the inductor L. In circumstances where the or each injector is discharged, activating the second switch Q2 causes charge to flow from the high voltage rail $V_{HI}$, through the second switch Q2 and the inductor L, and into the injector, during an injector charge phase, until an equilibrium voltage is reached (the point at which the voltage due to charge stored by the actuator equals the voltage difference between the high side and low side voltage inputs V1, V2). Hereinafter, the second switch will be referred to as the 'charge select switch' Q2.

A diode $D_{Q2}$ is connected across the discharge select switch Q1 and is oriented to permit current to flow from the ground connection GND through the inductor L to the high side input V1 when the charge select switch Q2 is deactivated, thus guarding against voltage peaks across the inductor L.

It should be appreciated that the inductor L constitutes a bidirectional current path since current flows in a first direction through the inductor L during the discharge phase and in a second, opposite direction during the injector charge phase.

The low side voltage input V2 of the injector bank circuit 32 is connected to the mid voltage rail $V_{MID}$ via a voltage sense resistor 44. A current sensing and comparator means 50 (hereinafter 'comparator module') is connected in parallel with the sense resistor 44 and is operable to monitor the current flowing therethrough. In response to the current flowing through the resistor 44, the comparator module 50 outputs a control signal 52 (hereafter $Q_{CONTROL}$) that controls the activation status of the discharge select switch Q1 and the charge select switch Q2 so as to regulate the peak current flowing out of, or into, the operating injector. In effect, the comparator module 50 controls the activation status of the switches Q1 and Q2 to 'chop' the injector current between maximum and minimum current limits and achieve a predetermined average charge or discharge current. By this means, a high degree of control is afforded over the amount of electrical charge that is transferred off of the stack 7 during a discharge phase and, conversely, onto the stack 7 during a charge phase.

The operation of the injector drive circuit 26 during a typical discharge phase, followed by a charge phase, is described below with reference to FIG. 3 and FIGS. 4*a* to 4*e*.

Initially, prior to time $T_0$, the injector drive circuit 26 is at equilibrium, that is to say both injectors INJ1 and INJ2 are fully charged such that no fuel injection is taking place. In these circumstances, the ICU 20 is in a wait state, indicated at step 100, awaiting an injection command signal from the ECU 22.

Following receipt of an injection command from the ECU 22 at step 102, the ICU 20 selects the injector that it is required to operate at step 104. For the purposes of this description, the selected injector is the first injector, INJ1. At substantially the same time, the ICU 20 initiates the discharge phase by enabling the discharge select switch Q1 so as to cause the injector INJ1 to discharge. A predetermined average discharge current through the injector is ensured by the comparator module 50 outputting the $Q_{CONTROL}$ signal between $T_0$ and $T_1$ to repeatedly deactivate and reactivate the discharge select switch Q1 such that the current remains within predetermined limits.

The ICU 20 applies the predetermined average discharge current to the stack for a period of time (from $T_0$ to $T_1$) sufficient to transfer a predetermined amount of charge off of the stack (it should be appreciated that the discharge phase timings are read from a timing map by the ICU 20).

Figures 4A, 4B, 4C, 4D, 4E:
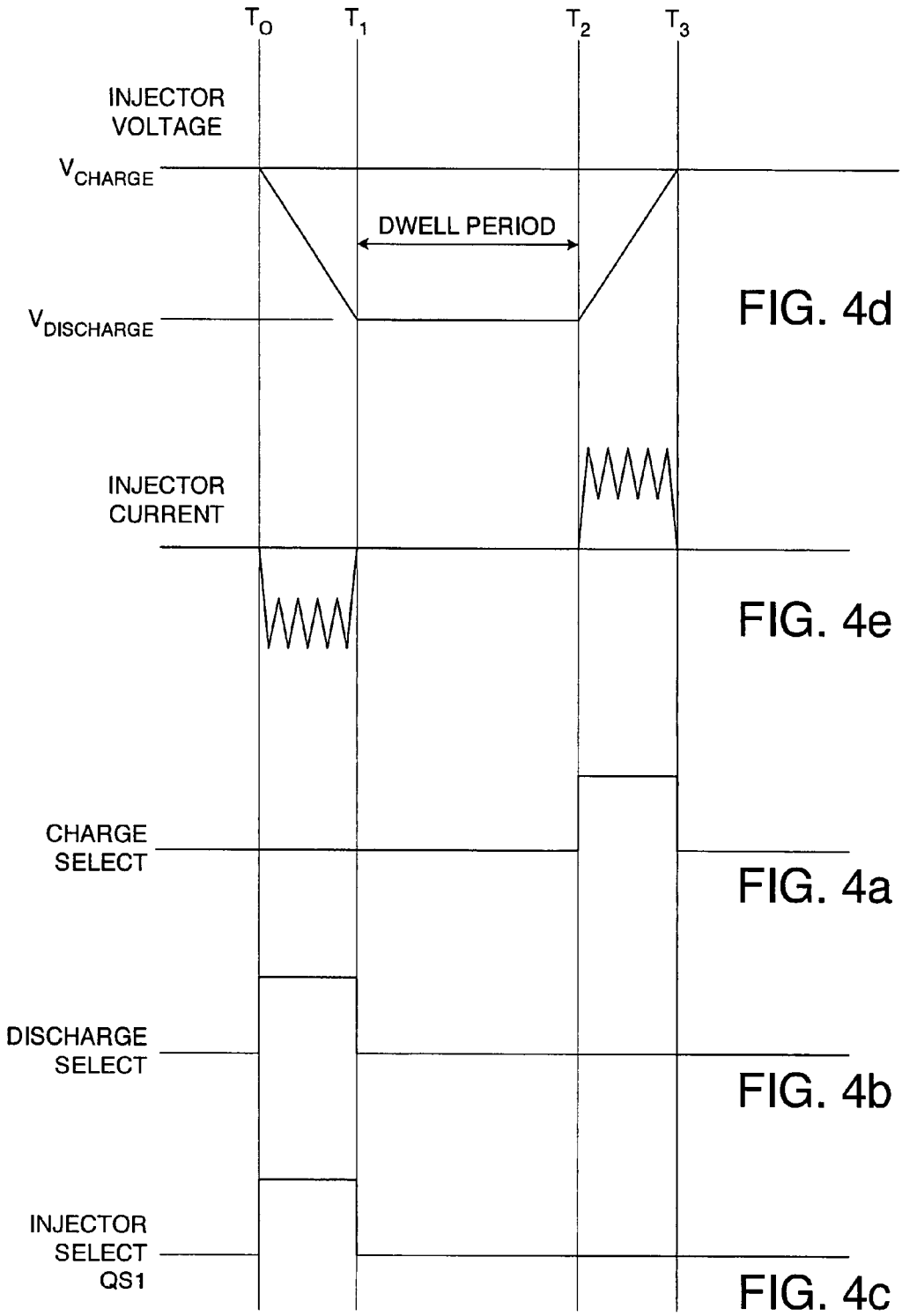
FIGS. 4*a*, 4*b* and 4*c* are state diagrams of charge select, discharge select and injector select switches according to the known control method of FIG. 3.
FIGS. 4*d* and 4*e* are profiles of voltage measured across the terminals of the injector and drive current flowing through current sensing means of the injector drive circuit of FIG. 1, according the method of FIG. 3.

At time $T_1$ (step 106), the ICU 20 deactivates the first injector select switch QS1 and disables the discharge select switch Q1, thus terminating the control signal $Q_{CONTROL}$, to prevent the injector discharging further. Thus during the time period $T_0$ to $T_1$ the stack voltage drops from a charged voltage level $V_{CHARGE}$ to a discharged voltage level $V_{DISCHARGE}$, as indicated in FIG. 4*d*.

At step 108, the ICU 20 maintains the injector INJ1 at the discharged voltage level $V_{DISCHARGE}$ for a predetermined dwell period, $T_1$ to $T_2$, such that the injector valve needle 8 is held open to perform an injection event. At the end of the dwell period, at step 110, the ICU 20 enables the charge select switch Q2 in order to start the injector charge phase so as to terminate injection. As a result, the high side voltage input V1 of the injector bank circuit 32 is connected to the high voltage rail $V_{HI}$ and charge begins to transfer into the injector INJ1.

As the current flowing into the injector increases, the comparator module 50 monitors the current flowing through the sense resistor 44 and controls the activation status of the charge select switch Q2, via the control signal $Q_{CONTROL}$ to ensure a predetermined average charging current level. Between time $T_2$ and $T_3$ the ICU 20 applies the predetermined average charging current to the stack for a period of time sufficient to transfer a predetermined amount of charge onto the stack. At time $T_3$ (step 112), the ICU 20 disables the charge select switch Q2 and returns to the waiting step 100 ready for initiation of another injection event.

FIGS. 5*a* and 5*b* show the principle characteristics of an injector drive current profile and a drive voltage profile as described above. In FIG. 5*a*, the drive current profile is substantially identical to that shown in FIG. 4*d*, but is filtered at 20 kHz that represents an upper threshold of the frequency response of the piezoelectric actuator 4. In practice, the chopping frequency that is applied to the piezoelectric actuator is in the order of 500 kHz although this is too high to result in movement of the piezoelectric actuator at a similar frequency.

The injector drive pulse is defined by the following characteristics:

i) a discharge pulse time ($T_{DISCHARGE}$)
ii) a charge pulse time ($T_{CHARGE}$)
iii) an 'injector on time' ($T_{ON}$) i.e. the interval between the start of stack discharge and the start of stack charge
iv) a positive peak current amplitude ($+I_{PEAK}$)
v) a negative current amplitude ($-I_{PEAK}$)

In order to vary the power output of the engine, it is necessary to vary the quantity of fuel that is delivered to the combustion chambers of the engine during each injection event. It is known for the ICU 20 to perform this function by varying the value of injector on time $T_{ON}$, which is the sum of the discharge pulse time $T_{DISCHARGE}$ and a dwell period defined between the end of the discharge phase and the start of the charge phase.

Figure 6:
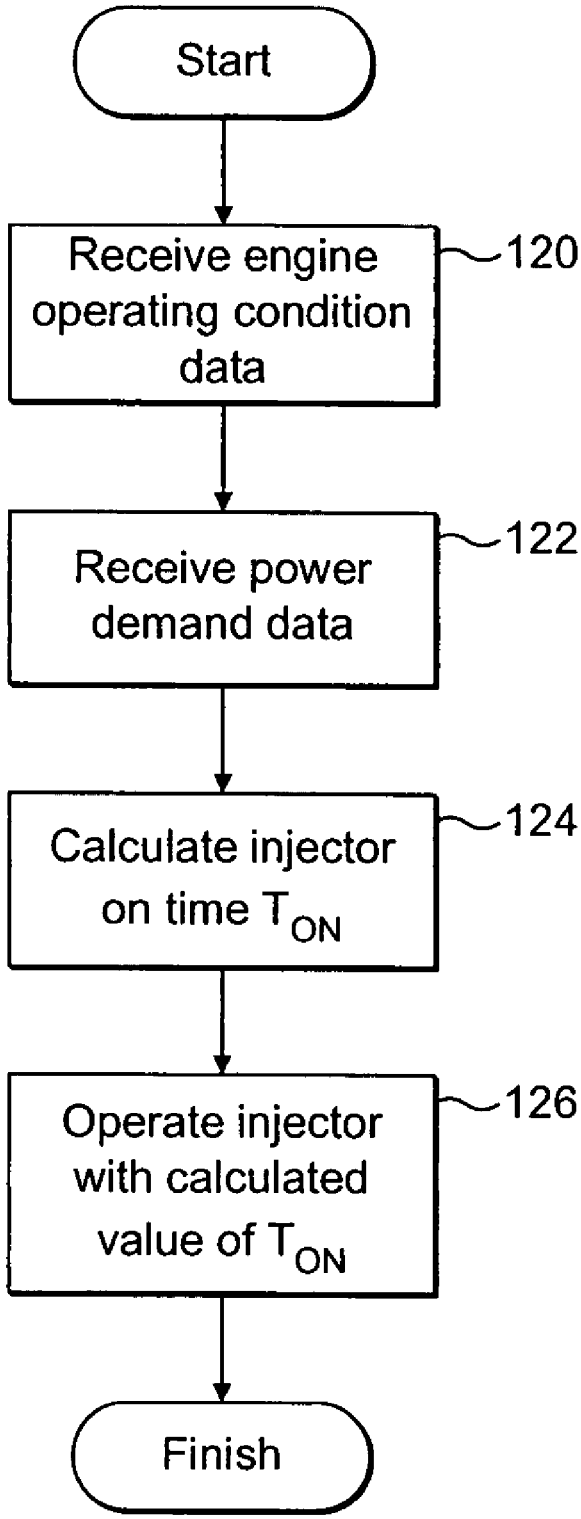
FIG. 6 is a flowchart of a known process that is implemented by the injector control unit in FIG. 1.

Referring to FIG. 6, at step 120 the ICU 20 receives data relating to the prevailing operating conditions of the engine: for example, engine speed, common rail fuel pressure, outside air temperature and the like. Then, at step 122, the ICU 20 receives data relating to the power requirement of the engine, such data being derived directly or indirectly from the accelerator pedal position of the vehicle. Following the acquisition of the vehicle data at steps 120 and 122, the ICU 20 calculates, at step 124, the value of injector on time $T_{ON}$ that will provide the correct fuel delivery volume to generate the required power output from the engine by referring to one or more data maps stored in the memory of the ICU 20. At step 126, the ICU 20 operates the injector drive circuit 26 according to the calculated value of $T_{ON}$.

Figure 7:
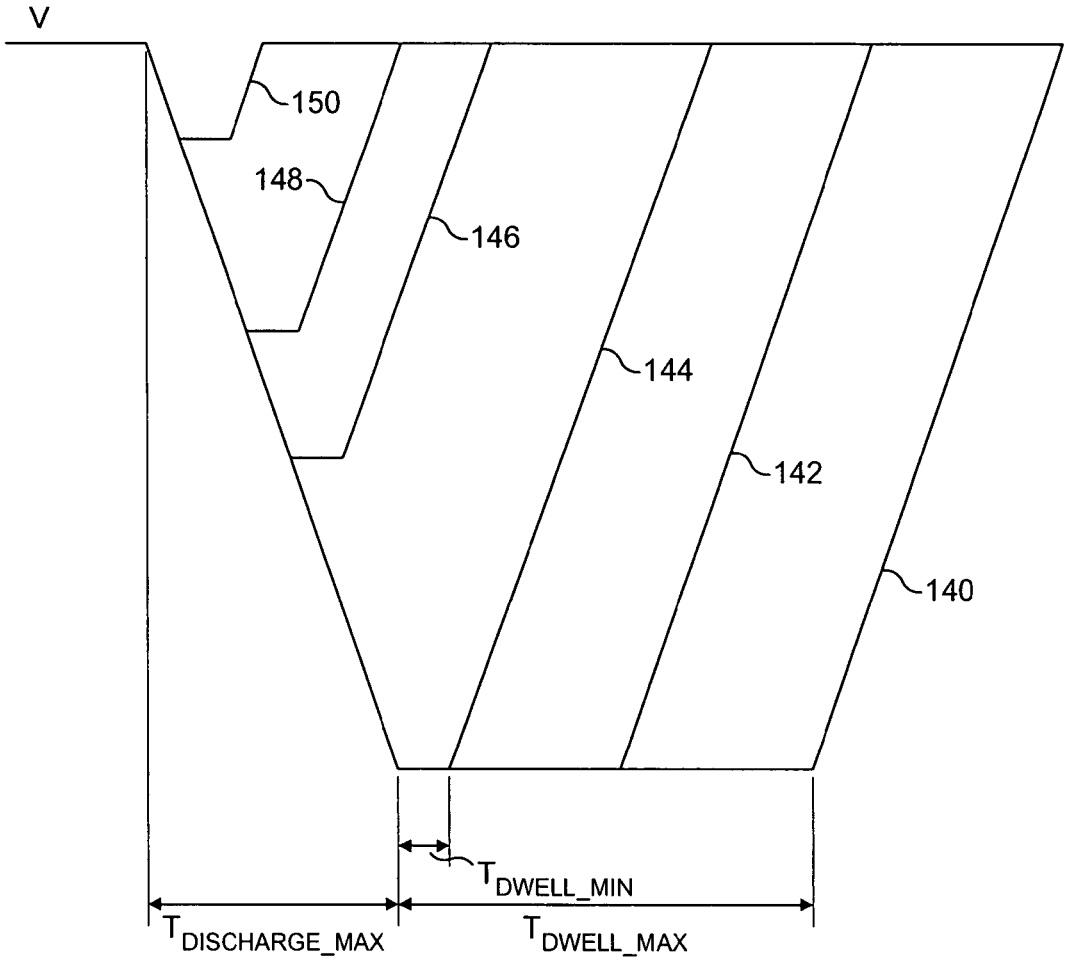
FIG. 7 is a plurality of known drive voltage profiles illustrating a sequential reduction in fuel delivery volume.

FIG. 7 shows a series of drive voltage profiles 140, 142, 144, 146, 148 and 150 (hereinafter 'drive pulses') that correspond to successively reduced fuel delivery volumes as calculated by the above described process implemented by the ICU 20.

For the drive pulses 140, 142 and 144, the discharge time $T_{DISCHARGE}$ is at a maximum value $T_{DISCHARGE_MAX}$ such that the injector is discharged by a maximum permitted value which is defined internally by the ICU 20. Therefore, a reduction in injector on time results in a reduction of the dwell period $T_{DWELL}$ from the maximum dwell period $T_{DWELL_MAX}$ corresponding to drive voltage profile 140, towards the minimum permitted dwell period $T_{DWELL_MIN}$ corresponding to drive voltage profile 144. It should be appreciated that the minimum dwell period $T_{DWELL_MIN}$ is a constraint imposed by the injector drive circuit 26 to ensure that electrical switching between a discharge phase and a charge phase can occur without causing damage to the injector drive circuit or the injector.

In order to reduce the fuel delivery volume further, the ICU 20 holds the dwell period constant at the minimum value $T_{DWELL_MIN}$ and reduces the discharge time period $T_{DISCHARGE}$ as can be seen by drive pulses 146, 148 and 150.

The inventors have now recognised that the drive pulse that is applied to the injector has a corresponding frequency domain signature that includes at least one maximum $F_{MAX}$ and at least one minimum $F_{MIN}$, as is indicated in an exemplary manner in FIG. 5*c*. It has been recognised that at certain delivery volumes, particularly at engine idle operating conditions, the characteristics of the frequency domain signature arising from a given drive pulse are such that the dominant frequencies of the drive pulse coincide closely with the resonant frequency of the apparatus (e.g. the engine) in which the injector is installed. In accordance with the invention, therefore, the characteristics of the drive pulse are modified in order to adapt the frequency domain signature thereof. In this way, the frequency domain signature of the drive pulse may be 'tuned' so that the energy peaks of the drive pulse are remote from and do not coincide with the resonant frequencies for a particular engine installation. The benefit of this invention is that a reduction in the amount of noise that is emitted from the injector is achieved.

This invention is particularly applicable to circumstances in which the injector is driven to perform injection events in which a relatively small amount of fuel is delivered to an associated combustion chamber, for example a pilot injection or a main injection during an engine idle condition. It is during these engine operating conditions that the mechanical and combustion noise of the engine is relatively quiet such that the noise generated by the injectors is most noticeable.

A first embodiment of the invention will now be described with reference to FIG. 8. In this embodiment, for injection events in which a relatively high volume of fuel is required to be delivered, for example during medium to high engine load conditions, the ICU 20 modifies the delivery volume by increasing or decreasing the injector on time appropriately, as can be seen on FIG. 8 by the injector drive pulses 200, 202 and 204 having successively decreasing values of injector on time $T_{ON_1}$, $T_{ON_2}$ and $T_{ON_3}$.

The dwell time for the drive pulse 204 represents the minimum dwell time as imposed by the switching requirements of the injector drive circuit 26. In order to decrease the delivery volume further, the dwell time must remain at this value so further reduction of injector on time results in the reduction of the discharge time $T_{DISCHARGE}$, as can be seen by the drive pulses 206, 208 and 210 having injector on times of $T_{ON_4}$, $T_{ON_5}$ and $T_{ON_6}$, respectively.

It should be noted that for each of the injector drive pulses 200, 202, 204, 206, 208 and 210, the peak discharge current $+I_{PEAK}$ remains constant at a value $I_1$ such that the gradient of the discharge slope remains substantially constant.

Up to this point, the way in which the fuel delivery volume is reduced is the same as that described with reference to FIGS. 6 and 7. However, the inventors have recognised that injector noise is particularly severe below a threshold of injector on time, more specifically approximately 200 μs, which is shown on FIG. 8 as $T_{ON_6}$.

It has been observed that injector noise at injector on time values below the threshold of $T_{ON_6}$ is more severe because the reciprocal of the injector on time value is approximately equal to the resonant frequency of the injector installation i.e. the engine in which the injector is received, in use.

Therefore, in order to reduce the delivery volume below that which is achievable at the first threshold, the ICU 20 holds the injector on time constant (at $T_{ON_6}$) and reduces the peak current amplitude that is applied to the actuator during the discharge phase of an injection. On FIG. 8, this can be seen by the injector drive pulses 212, 214, 216 and 218 having successively reduced discharge gradients $I_2$, $I_3$, $I_4$ and $I_5$, respectively. It should be noted that for each of the injector drive pulses 212, 214, 216 and 218 the injector discharge time period remains substantially constant at $T_{DISCHARGE_1}$.

However, it is not possible to reduce the value peak current amplitude indefinitely since too low a value may adversely affect the fuel delivery rate. Due to the limited range within which it is possible to reduce the value of $+I_{PEAK}$, if it required to further reduce the total volume of fuel delivered during an injection event, the ICU 20 reduces the discharge pulse time $T_{DISCHARGE}$. This is shown on FIG. 8 by the drive voltage profiles 220, 222 and 224 having successively reduced injector discharge time periods $T_{DISCHARGE_2}$, $T_{DISCHARGE_3}$ and $T_{DISCHARGE_4}$. It should be noted that for the drive voltage profiles 220, 222 and 224 the values of injector on time and peak current amplitude remain at their minimum threshold values $T_{ON_6}$ and $I_5$ as has been described above.

The drive pulse 224 represents the maximum dwell period that is possible for small values of needle lift in order to avoid injection instabilities. Therefore, in order to further reduce the fuel delivery volume, the ICU 20 holds the dwell period constant and reduces the discharge time period further as shown by drive pulses 226 and 228.

Figure 9:
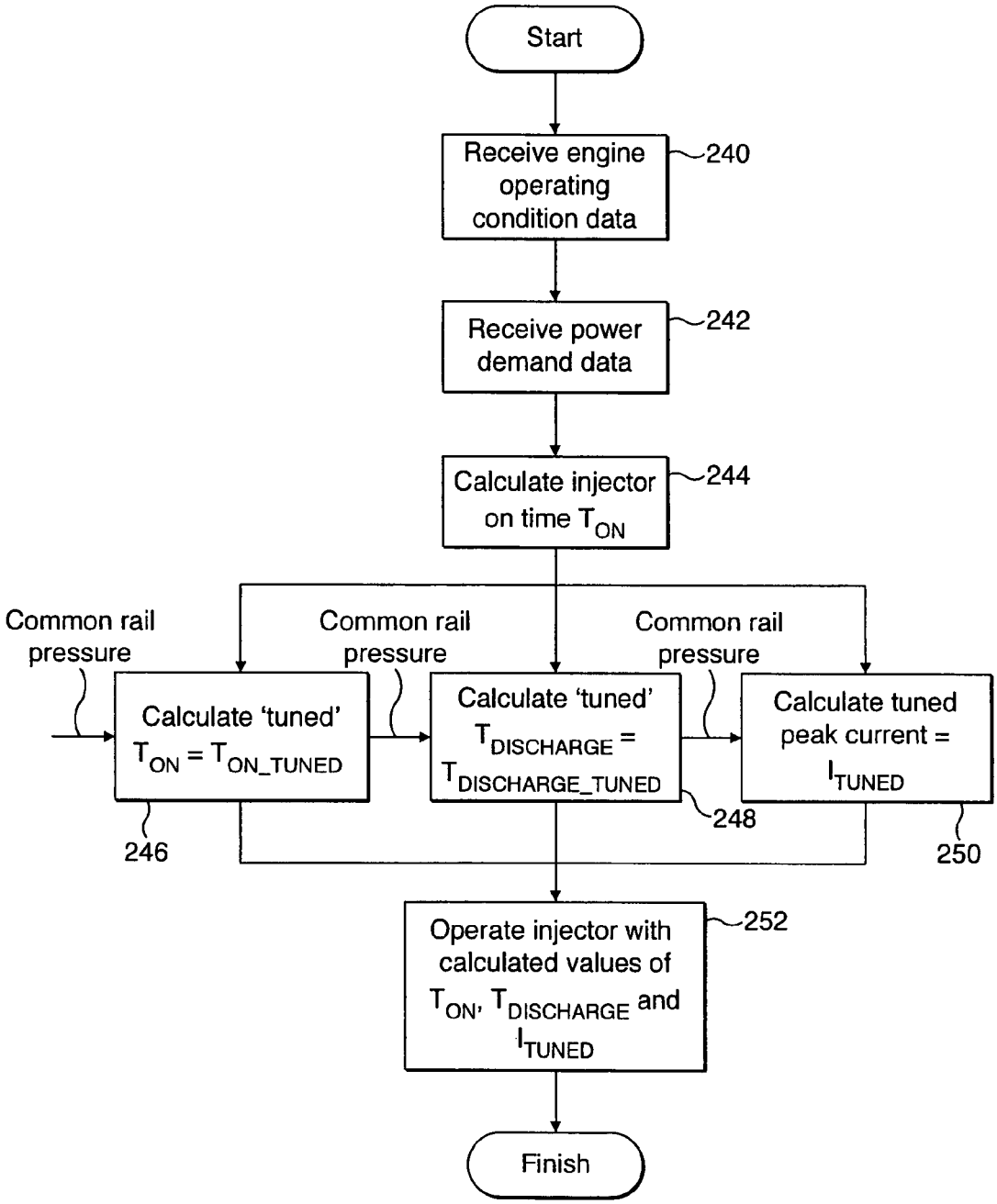
FIG. 9 is a flowchart of a process according to the first embodiment of the invention that may be implemented by the injector control unit in FIG. 1.

Referring to FIG. 9, which represents the process carried out by the ICU 20 to implement this embodiment, at step 240 the ICU 20 receives data relating to the prevailing operating conditions of the engine: for example engine speed, common rail fuel pressure, outside air temperature and the like. At step 242 the ICU 20 receives data relating to the power requirement of the engine, such data being derived directly or indirectly from the accelerator pedal position of the vehicle. Following the acquisition of the vehicle data at steps 240 and 242, the ICU 20 calculates, at step 244, the value of injector on time $T_{ON}$ (hereinafter $T_{ON_DEMAND}$) that will provide the correct fuel delivery volume to generate the required power output from the engine by referring to one or more data maps stored in the memory of the ICU 20. However, instead of using the value of $T_{ON_DEMAND}$ directly to operate the injector drive circuit 26, as is consistent with the known method of controlling the injector as described above with reference to FIG. 6, the ICU 20 inputs the calculated value of $T_{ON_DEMAND}$ into three further functional modules represented by steps 246, 248 and 250.

At step 246, the ICU 20 refers to a first data map stored in its memory to calculate a tuned or revised value of injector on time (hereinafter $T_{ON_TUNED}$) based on the value of $T_{ON_DEMAND}$ and data relating to common rail fuel pressure. The data map relates values of $T_{ON_DEMAND}$ to $T_{ON_TUNED}$ to select a value for $T_{ON_TUNED}$ which takes into account the effects of the resonant frequency of the injector installation.

At step 248, the ICU 20 refers to a second data map stored in its memory to calculate a revised value of discharge time (hereinafter $T_{DISCHARGE_TUNED}$) based on the value of $T_{ON_DEMAND}$ and data relating to common rail fuel pressure. The second data map relates values of $T_{ON_DEMAND}$ to $T_{DISCHARGE_TUNED}$ to select a value for $T_{DISCHARGE_TUNED}$ which gives the required fuel volume delivery in conjunction with $T_{ON_TUNED}$.

At step 250, the ICU 20 refers to a third data map stored in its memory to calculate a revised value of peak discharge current (hereinafter $I_{TUNED}$) based on the value of $T_{ON_DEMAND}$ and data relating to common rail fuel pressure. The third data map relates values of $T_{ON_DEMAND}$ to $I_{TUNED}$ to select a value for $I_{TUNED}$ which takes into account the amplitude of the resonant frequency of the injector installation.

The values of $T_{ON_TUNED}$, $T_{DISCHARGE_TUNED}$ and $I_{TUNED}$ are thereafter used by the ICU 20 at step 252 to operate the injector via the injector drive circuit 26 to give the demanded fuel delivery. The tuned injector on time $T_{ON_TUNED}$, the tuned discharge time $T_{DISCHARGE_TUNED}$, and the tuned current $I_{TUNED}$, therefore all contribute to the fuelling. The first, second and third data maps are determined in an off line environment. The characteristics of the drive pulse are modified in steps 246, 248 and 250 in real time to ensure that the frequency composition of the drive pulse does not include energy peaks that reside in frequency bands consistent with the resonant frequencies of the injector installation.

Figure 10:
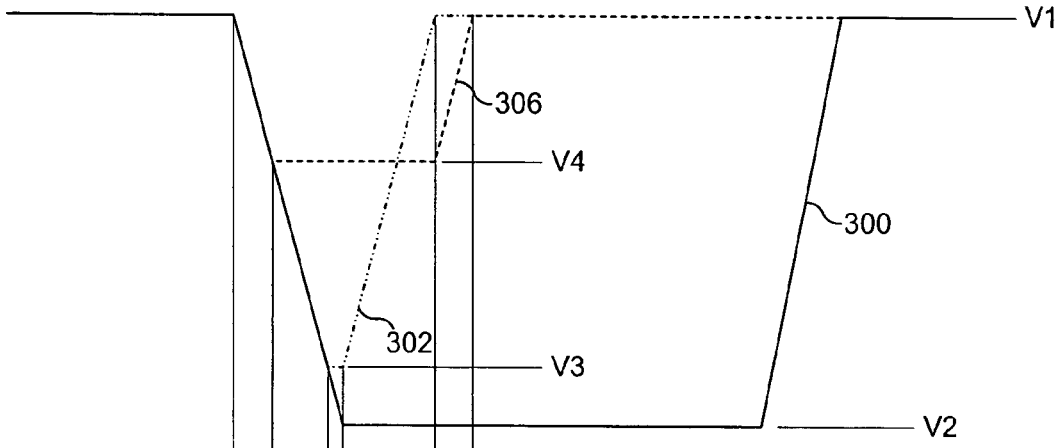
FIG. 10 is a graph comparing a known drive voltage profile with a drive voltage profile in accordance with a second embodiment of the invention.
Figure 11:
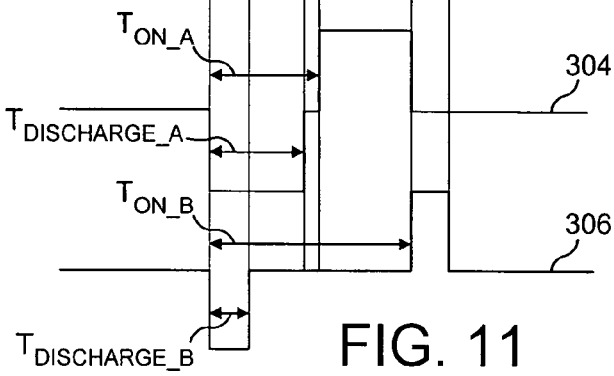
FIG. 11 shows drive current profiles corresponding to the drive voltage profiles of FIG. 10.

FIGS. 10 and 11 show a second embodiment of the invention which is a specific implementation of the tuned drive pulse concept described above. In FIG. 10, a drive pulse 300 is shown for a typical injection event that corresponds approximately to a medium engine load operating condition. As can be seen, the injector is discharged from a starting voltage level V1 to a predetermined voltage level V2 at which point the voltage remains for a significant dwell period before the injector is recharged back to the starting voltage level V1 to terminate the injection event.

Also shown in FIG. 10 is a typical drive pulse 302 that corresponds to a low engine load operating condition, for example when the engine is running at idle. As can be seen, the injector is discharged from the starting voltage level V1 at the same rate as for the drive pulse 300, but to a voltage level V3 which is greater than V2. The voltage remains at V3 for a very short dwell period, which is the minimum permissible dwell period as required by the switching characteristics of the injector drive circuit 26, before being recharged to the starting voltage V1. A drive current profile 304 that corresponds to the drive pulse 302 is shown in FIG. 11. The drive current profile 304 has an injector on time period of $T_{ON_A}$ and a discharge time period of $T_{DISCHARGE_A}$.

A drive pulse 306 for an 'engine idle' operating condition that is modified in accordance with the second embodiment of the invention is also shown in FIG. 10 and the corresponding drive current profile 308 is shown in FIG. 11. The modification involves employing a less aggressive drive pulse in order to ameliorate the audible noise emissions of the injector at low engine loads. As can be seen, the injector is discharged at the same rate as the drive pulses 300 and 302 to avoid a reduction in initial rate of fuel injection. However, the discharge time period of the drive pulse 206 (shown as $T_{DISCHARGE_B}$ on FIG. 11) is significantly shorter than the discharge time period $T_{DISCHARGE_A}$ for the drive pulse 302, the dwell time has been increased and the injector on time period $T_{ON_B}$ has been increased. As a result, the injector is discharged to a lower magnitude voltage V4, which reduces the axial displacement of the injector valve needle, but the total time for which the injector valve needle is disengaged from its seat is increased.

Figure 12A:
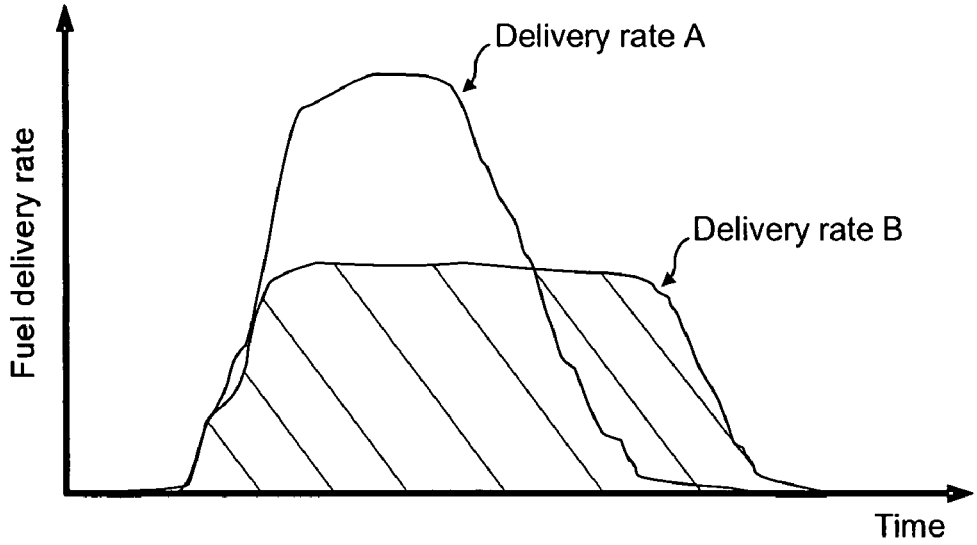
FIG. 12*a* and FIG. 12*b* are graphs of needle lift and fuel delivery rate corresponding to the drive voltage profiles and drive current profiles of FIGS. 10 and 11.
Figure 12B:
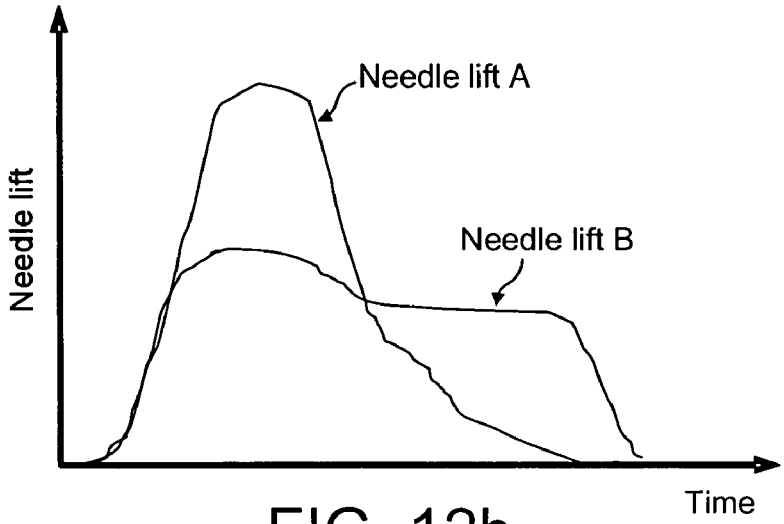

The effect of the modified drive voltage profile can be seen from FIGS. 12*a* and 12*b*, which show injector valve needle lift profiles (needle lift A and needle lift B) and delivery rate profiles (delivery rate A and delivery rate B) for each of the drive pulses 302, 306 respectively, of FIG. 10.

In FIG. 12*a*, needle lift A corresponds to the drive voltage profile 302 that is known for an engine idle operating condition and shows the injector valve needle lifting rapidly to reach its maximum lift and then lowering substantially immediately. Referring to the delivery rate A in FIG. 12*b*, the peak delivery rate is relatively high but the delivery time is relatively short.

In contrast needle lift B, which corresponds to the drive voltage profile 306 modified in accordance with the second embodiment of the invention, includes a relatively low peak lift but the injector valve needle remains open for a longer period of time. Similarly, the corresponding delivery rate B in FIG. 13*b* has a lower peak delivery rate than delivery rate A but continues for a comparatively long period of time.

Although the delivery rate profiles A and B are quite different in shape, the total volume of fuel delivered, which is represented by the area under the curves, is substantially equal such that the volume of fuel delivered from injection event to injection event remains consistent. At the same time, by modifying the drive voltage profile to reduce the discharge time and increase the injector on time, the injector is driven with a less energetic drive voltage profile. This has the effect of reducing the total energy that is transferred to and from the injector, thus reducing the electrical activity of the piezoelectric actuator and reducing needle impact noise as it disengages and reengages the valve needle seat. A further benefit is that the frequency domain signature of the drive pulse is modified to ensure that the energy peaks thereof do not coincide with the resonant frequency of the injector installation.

Figure 13:
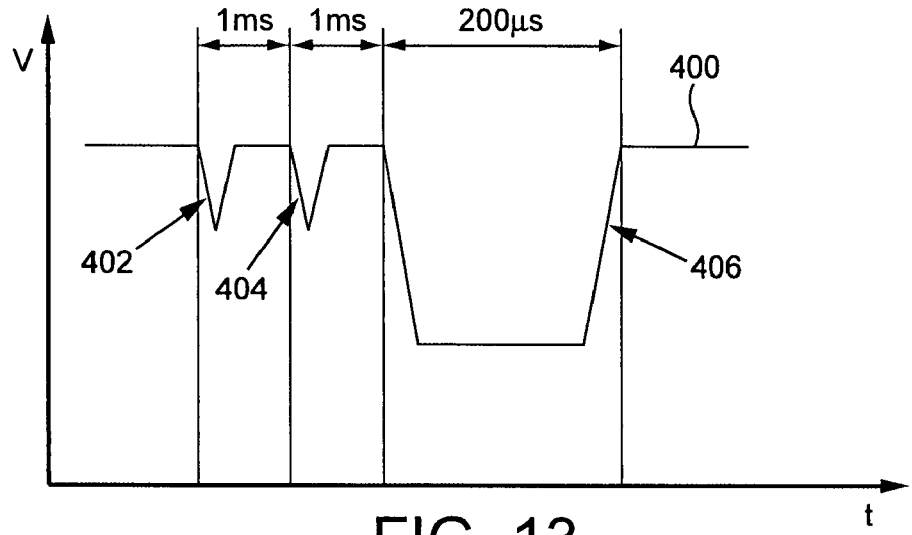
FIG. 13 is a drive voltage profile of a third embodiment of the invention.

A third embodiment of the invention is described below with reference to FIG. 13 which shows a typical injector voltage drive profile 400 for a first pilot injection event 402 followed by a second pilot injection event 404 followed by a main injection event 406.

Figure 14:
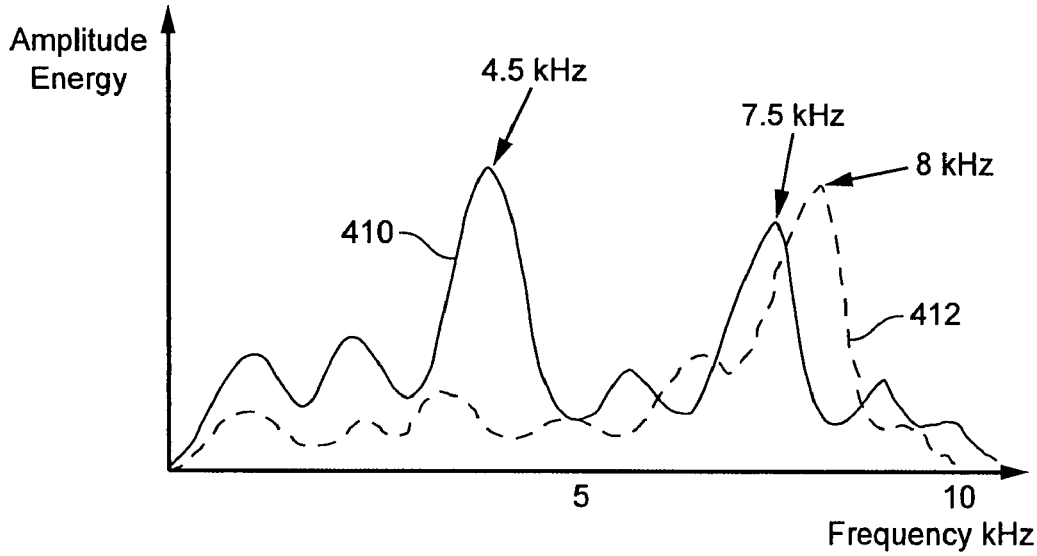
FIG. 14 is a frequency domain diagram associated with the drive voltage profile of FIG. 13.

In FIG. 14, a frequency domain signature 410 of the drive voltage profile 400 is shown to include peaks in energy at approximately 4.5 kHz and 7.5 kHz. However, in order to achieve further reductions in noise emitted from the injectors, particularly at engine idle operating conditions, in this embodiment of the invention the separation between the first pilot injection event 402 and the second pilot injection event 404, and between the second pilot injection event 404 and main injection event 406 is modified so as to affect directly the energy composition of the frequency signature.

For example, by appropriate modification of the separation between the pilot injections and the main injection, the frequency signature may be altered such that the energy peak resides at a location remote from the resonant frequency of the injector installation. This can be seen on frequency domain signature plot 412 in FIG. 14 that has a energy peak at approximately 8 kHz.

The ICU 20 is specifically adapted to modify the standard separation intervals appropriately by reference to a data map. For example, in normal operation the total number of pilot, main and post injections, the required charge transfer and the relative separation intervals of each injection are determined by the ICU 20 in order to meet specific engine power requirements whilst optimising fuel economy and emissions. One way to implement this embodiment of the invention is to configure the ICU 20 to consult a data map containing separation offsets. An appropriate offset would then be applied to the predetermined separation intervals. It should be noted that separation offsets would be calculated so as not to adversely affect fuel economy or emissions.

It will be appreciated that various modifications may be made to the above described embodiments without departing from the scope of the invention, as defined by the claims.

Figure 8:
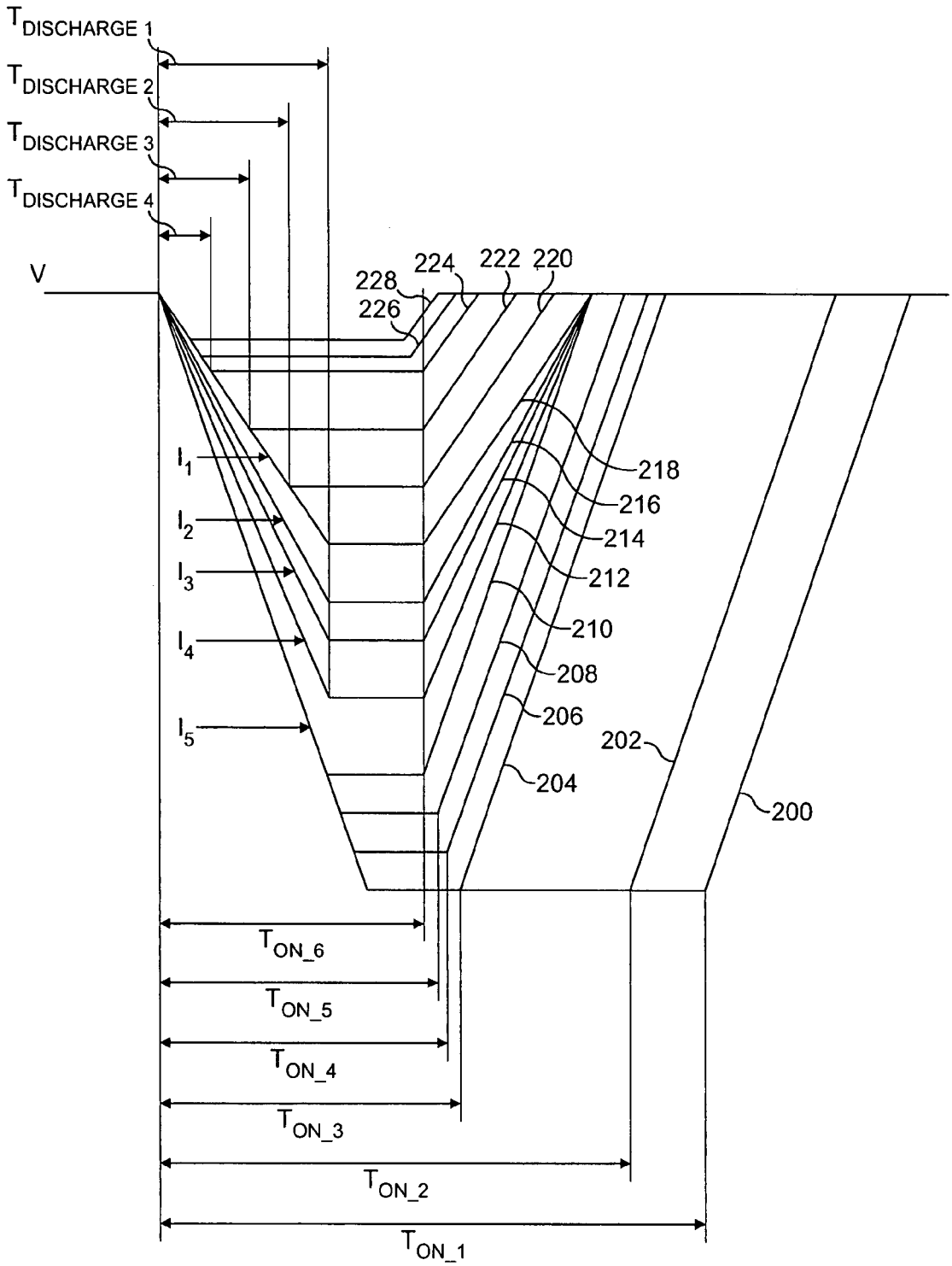
FIG. 8 is a plurality of drive voltage profiles illustrating a sequential reduction in fuel delivery volume in accordance with a first embodiment of the invention.

For example, in FIG. 8 it has been described that the ICU 20 reduces the peak current of the discharge phase, it should be appreciated that this is an optional enhancement to the embodiment. As an alternative, the ICU 20 could be configured just to reduce the discharge time and increase the dwell period so that the injector on time remains constant.

Further, although the above noise reduction concepts have been described with reference to a piezoelectric injector of the 'de-energise to inject' type, the invention also applies to injectors of the 'energise to inject' type.

The invention claimed is:

1. A method of operating a fuel injector having a piezoelectric actuator operable by applying a drive pulse thereto, wherein the drive pulse has a frequency domain signature, the method including;

determining at least one resonant frequency of an injector installation in which the injector is received, in use; and modifying the drive pulse such that a maximum of the frequency domain signature thereof does not coincide with the determined at least one resonant frequency of the injector installation, wherein modifying the drive pulse includes determining a demanded fuel volume to be delivered during the drive pulse based on an engine operating condition, determining a tuned injector on time value (TON_TUNED) based on the demanded fuel volume and the at least one resonant frequency of the injector installation, determining a peak discharge/charge current amplitude value (ITUNED) and a discharge time period (TDISCHARGE) based on the demanded fuel volume and the tuned injector on time value (TON_TUNED), and operating the fuel injector according to the determined values of the tuned injector on time value (TON_TUNED), the peak discharge/charge current amplitude value (ITUNED), and the discharge time period (TDISCHARGE).

2. The method of claim 1, wherein, in order to reduce the volume of fuel delivered by the injector during a first series of successive injection events, the method includes reducing the tuned injector on time value (TON_TUNED) to a predetermined injector on time threshold value (TON_6) and, for subsequent reductions in fuel delivery volume, holding the tuned the injector on time value (TON_TUNED) substantially constant and thereafter reducing the discharge time period (TDISCHARGE).

3. The method of claim 2, wherein, for a subsequent series of successive injection events, the method further includes holding the discharge time period (TDISCHARGE) substantially constant and reducing the peak discharge/charge current amplitude value (ITUNED) to a predetermined peak current threshold value (I5).

4. The method of claim 1, wherein, in order to reduce the volume of fuel delivered by the injector during a first series of successive injection events, the method includes reducing the tuned injector on time value (TON_TUNED) to a predetermined injector on time threshold value (TON_6) and, for subsequent reductions in fuel delivery volume, holding the tuned injector on time value (TON_TUNED) substantially constant and thereafter reducing the peak discharge/charge current amplitude value (ITUNED) to a predetermined peak current threshold value (I5).

5. The method of claim 4, wherein, for a subsequent series of successive injection events, the method further includes holding the injector on time period substantially constant at the predetermined injector on time threshold value (TON_6), holding the peak discharge/charge current amplitude value (ITUNED) at the predetermined peak current threshold value (I5), and reducing the discharge time period (TDISCHARGE) in order to further reduce the volume of fuel delivered by the injector, in use.

6. The method of claim 1, wherein the step of determining the tuned injector on time value (TON_TUNED) includes referring to a first data map relating an injector on time period (TON_DEMAND) to the tuned injector on time value (TON_TUNED).

7. The method of claim 6, wherein the step of determining the discharge time period (TDISCHARGE) includes referring to a second data map relating the injector on time period (TON_DEMAND) to the discharge time period (TDISCHARGE).

8. The method of claim 6, wherein the step of determining a peak discharge/charge current amplitude value (ITUNED) includes referring to a third data map relating the injector on time period (TON_DEMAND) to the peak discharge/charge current amplitude value (ITUNED).

9. A method of operating a fuel injector having a piezoelectric actuator operable by applying a drive pulse thereto, wherein the drive pulse is defined by two or more drive pulse characteristics including a discharge time period (TDISCHARGE), an injector on time period (TON), and a peak discharge/charge current amplitude (I), and has a frequency domain signature, the method including;

determining at least one resonant frequency of an injector installation in which the injector is received, in use;

modifying at least one of said characteristics of the drive pulse such that a maximum of the frequency domain signature thereof does not coincide with the determined at least one resonant frequency of the injector installation, wherein, in order to reduce the volume of fuel delivered by the injector, the method includes initially reducing the injector on time period (TON) to a predetermined injector on time threshold value (TON_6) and, for subsequent reductions in fuel delivery volume, holding the injector on time period substantially constant and thereafter reducing the discharge time period (TDISCHARGE).

10. A method of operating a fuel injector having a piezoelectric actuator, the method comprising:

determining at least one resonant frequency of an injector installation in which the injector is received, in use, applying a drive pulse to the actuator, the drive pulse comprising first, second and third injection drive pulses and having a frequency domain signature; and selecting a separation time period between the first injection drive pulse and the second injection drive pulse and/or a separation time period between the second injection drive pulse and the third injection drive pulse, and modifying the drive pulse so as to modify the frequency domain signature of the drive pulse such that a maximum of the frequency domain signature does not coincide with the determined at least one resonant frequency of the injector installation, wherein modifying the drive pulse includes determining a demanded fuel volume to be delivered during the drive pulse based on an engine operating condition, determining a tuned injector on time value (TON_TUNED) based on the demanded fuel volume and the at least one resonant frequency of the injector installation, determining a peak discharge/charge current amplitude value (ITUNED) and a discharge time period (TDISCHARGE) based on the demanded fuel volume and the tuned injector on time value (TON_TUNED), and operating the fuel injector according to the determined values of the tuned injector on time value (TON_TUNED), the peak discharge/charge current amplitude value (ITUNED), and the discharge time period (TDISCHARGE).

11. A computer program product comprising at least one computer program software portion which, when executed in an executing environment, is operable to implement the method of claim 1.

12. A data storage medium having the or each software portion of claim 11 stored thereon.

13. A microcomputer provided with the data storage medium of claim 12 thereon.

14. A computer program product comprising at least one computer program software portion which, when executed in an executing environment, is operable to implement the method of claim 9.

15. A data storage medium having the or each software portion of claim 14 stored thereon.

16. A microcomputer provided with the data storage medium of claim 15 thereon.

17. A computer program product comprising at least one computer program software portion which, when executed in an executing environment, is operable to implement the method of claim 10.

18. A data storage medium having the or each software portion of claim 17 stored thereon.

19. A microcomputer provided with the data storage medium of claim 18 thereon.

* * * * *